US008595951B2

(12) United States Patent
Peet

(10) Patent No.: US 8,595,951 B2
(45) Date of Patent: Dec. 3, 2013

(54) RESERVOIR BLADDER DRYER SYSTEM

(75) Inventor: Blair G. Peet, St. Maries, ID (US)

(73) Assignee: Peet Shoe Dryer, Inc., St. Maries, ID (US)

( * ) Notice: Subject to any disclaimer, the term of this patent is extended or adjusted under 35 U.S.C. 154(b) by 229 days.

(21) Appl. No.: 12/657,122

(22) Filed: Jan. 13, 2010

(65) Prior Publication Data

US 2011/0167665 A1 Jul. 14, 2011

(51) Int. Cl.
*F26B 25/06* (2006.01)

(52) U.S. Cl.
USPC ..... 34/105; 34/218; 34/239; 248/97; 222/105; 211/12; D32/8

(58) Field of Classification Search
USPC ..... 34/103, 104, 105, 201, 210, 218, 232, 34/239; 248/95, 96, 97, 339; 222/105, 222/175; 211/12, 15, 85.4; D32/8, 25, 58
See application file for complete search history.

(56) References Cited

U.S. PATENT DOCUMENTS

| | | | | | |
|---|---|---|---|---|---|
| 2,239,572 | A * | 4/1941 | Richa | 223/73 |
| 2,317,924 | A * | 4/1943 | Lendle | 223/67 |
| 3,798,788 | A * | 3/1974 | Kuntz | 34/104 |
| 4,727,656 | A * | 3/1988 | Jannach et al. | 34/104 |
| 5,080,237 | A * | 1/1992 | Hefner | 211/85.15 |
| 5,188,244 | A * | 2/1993 | Hollstegge | 211/85.15 |
| 5,421,542 | A * | 6/1995 | Crutcher | 248/95 |
| 5,469,635 | A * | 11/1995 | Lamontagne et al. | 34/104 |
| 5,566,838 | A * | 10/1996 | Tseng | 211/37 |
| 5,641,137 | A * | 6/1997 | Collier | 248/95 |
| 5,778,556 | A * | 7/1998 | Ohsugi | 34/106 |
| 5,862,606 | A * | 1/1999 | Jannach | 34/106 |
| 6,243,967 | B1 * | 6/2001 | Dovolas | 34/103 |
| 6,640,982 | B1 * | 11/2003 | Bjerke | 211/85.15 |
| 6,701,947 | B1 * | 3/2004 | Ramos | 135/34.2 |
| D488,997 | S * | 4/2004 | Angeletta | D8/373 |
| 6,802,136 | B2 * | 10/2004 | Merchant | 34/104 |
| 6,983,754 | B1 * | 1/2006 | Anderson et al. | 134/22.1 |
| 7,121,017 | B2 * | 10/2006 | DuRapau | 34/381 |
| 7,568,673 | B2 * | 8/2009 | Evingson | 248/339 |
| 7,886,459 | B2 * | 2/2011 | Ruess | 34/103 |
| 8,024,870 | B1 * | 9/2011 | Ballentine et al. | 34/104 |

(Continued)

FOREIGN PATENT DOCUMENTS

| | | | | |
|---|---|---|---|---|
| DE | 4023722 | A1 * | 1/1992 | B01D 5/00 |
| EP | 429953 | A2 * | 6/1991 | D06F 58/24 |

(Continued)

*Primary Examiner* — Steve M Gravini
(74) *Attorney, Agent, or Firm* — Wells St. John, PS

(57) ABSTRACT

This invention discloses a dryer for insertion into a cavity of a reservoir bladder with a fill inlet, a primary internal cavity and a back pocket cavity portion, the dryer including a framework configured for insertion into a water inlet of an internal cavity of reservoir bladder which includes a primary internal cavity and a back pocket cavity portion, and a first air passageway formed by the framework and configured to receive heated air from an air supply passageway and heater, and to direct the heated air to the primary internal cavity. The invention also discloses the framework forming a second air passageway which is configured to direct heated air to the back pocket cavity portion and such a framework providing a biased tab mounted to the framework configured to provide a biased securing tab for applying outward pressure to the water inlet of the reservoir bladder, for securing the reservoir bladder to the framework.

5 Claims, 10 Drawing Sheets

(56) References Cited

U.S. PATENT DOCUMENTS

| | | | | |
|---|---|---|---|---|
| D653,007 | S * | 1/2012 | Beckett | D32/8 |
| 8,177,097 | B2 * | 5/2012 | Duran | 222/105 |
| 8,186,075 | B2 * | 5/2012 | Beckett | 34/106 |
| D664,321 | S * | 7/2012 | Williams | D32/58 |
| 2003/0106895 | A1 * | 6/2003 | Kalal | 220/9.2 |
| 2004/0244216 | A1 * | 12/2004 | Poole | 34/103 |
| 2007/0006482 | A1 * | 1/2007 | Sabounjian | 34/442 |
| 2007/0261263 | A1 * | 11/2007 | Lee | 34/201 |
| 2008/0120865 | A1 * | 5/2008 | Smith | 34/239 |
| 2008/0279902 | A1 * | 11/2008 | Luria et al. | 424/401 |
| 2009/0287300 | A1 * | 11/2009 | Dave et al. | 623/1.42 |
| 2011/0132932 | A1 * | 6/2011 | Duran | 222/175 |
| 2011/0167665 | A1 * | 7/2011 | Peet | 34/218 |

FOREIGN PATENT DOCUMENTS

| | | | | |
|---|---|---|---|---|
| FR | 2791585 | A1 * | 10/2000 | B08B 3/00 |
| JP | 07231919 | A * | 9/1995 | A61H 1/02 |
| WO | WO 2009128945 | A2 * | 10/2009 | B23C 9/18 |

* cited by examiner 106
103b
107
105
121

120
104
110
107
105
113
103a
111

112
101

115

RESERVOIR BLADDER DRYER SYSTEM

CROSS REFERENCE TO RELATED APPLICATION(S)

There are no related applications.

TECHNICAL FIELD

This invention generally pertains to a reservoir bladder dryer system for insertion into the bladder of a reservoir for liquids and providing drying thereof.

BACKGROUND OF THE INVENTION

An entire industry has developed around various new types of hydration devices used in numerous outdoor and athletic activities. Many of the hydration devices are soft and include a flexible or semi flexible bladders to contain the fluid, along with a hose or water delivery conduit attached to the bladder and which allows the user to suck or draw fluid from the bladder through the conduit.

Although hydration devices have been used for several years with bladders, the contamination and organic growth of materials such as mold within the bladders and the water delivery conduit's has been well recognized but not heretofore solved to an acceptable or desirable level. A primary part of the problem is that when most bladders are stored or not in use, moisture remains within the bladder reservoir. The stagnant water remaining then facilitates or promotes the growth of the undesirable organics such as mold.

There have been past devices which include a simple framework which is placed within the internal cavity of the bladder to keep one side wall from being in constant contact with the other side wall in the hopes that drying will occur. Furthermore, the ports where the fluid delivery conduits are attached to the bladder are typically located offset from an end of the bladder, thereby creating an internal cavity area on one side of the port and a smaller back internal cavity area on the other side of the internal cavity of the bladder. This makes complete drying even more difficult, especially in the smaller back internal cavity area within the bladder.

It is therefore an object of embodiments of this invention to provide a bladder reservoir or internal cavity drying system that provides a more complete drying of the internal cavity, including the back pocket area of the internal cavity.

It is also an object of embodiments of this invention to provide a wider reservoir or internal cavity drying system that securely attaches to the drying apparatus in the desired position.

It is also an objective of embodiments of this invention to provide a system which greatly reduces or eliminates the propensity for mold and other organics to form or accumulate in the entire bladder and not just in one portion or the other, such as in the primary internal cavity. This system had the advantage of providing, directing or guiding air to the back portion as well as the main portion of the internal cavity of the reservoir bladder.

While the invention was motivated in addressing some objectives, it is in no way so limited. The invention is only limited by the accompanying claims as literally worded, without interpretative or other limiting reference to the specification, and in accordance with the doctrine of equivalents. Other objects, features, and advantages of this invention will appear from the specification, claims, and accompanying drawings which form a part hereof. In carrying out the objects of this invention, it is to be understood that its essential features are susceptible to change in design and structural arrangement, with only one practical and preferred embodiment being illustrated in the accompanying drawings, as required.

BRIEF DESCRIPTION OF THE DRAWINGS

Preferred embodiments of the invention are described below with reference to the following accompanying drawings:

FIG. 12 is a second side view of the embodiment of the reservoir bladder dryer system illustrated in FIG. 2 with a bladder mounted thereon, and illustrating the movement of heated air both toward the main portion of the internal cavity of the bladder and toward the back pocket of the internal cavity of the bladder.

DETAILED DESCRIPTION OF THE PREFERRED EMBODIMENTS

Many of the fastening, connection, manufacturing and other means and components utilized in this invention are widely known and used in the field of the invention described, and their exact nature or type is not necessary for an understanding and use of the invention by a person skilled in the art or science; therefore, they will not be discussed in significant detail. Furthermore, the various components shown or described herein for any specific application of this invention can be varied or altered as anticipated by this invention and the practice of a specific application or embodiment of any element may already be widely known or used in the art or by persons skilled in the art or science; therefore, each will not be discussed in significant detail.

The terms "a", "an", and "the" as used in the claims herein are used in conformance with long-standing claim drafting practice and not in a limiting way. Unless specifically set forth herein, the terms "a", "an", and "the" are not limited to one of such elements, but instead mean "at least one".

The basic reservoir drying system is configured to be mounted to any one of a number of different sources of heat, such as well known Peet brand heaters and columns, which may also comprise a part of the system. The heaters and air supply components are preferably a source of heat such as an electrical or propane heater and an air supply passageway for the air to rise by natural or forced convection to the framework of this invention for distribution within a mounted reservoir bladder.

Figure 1:
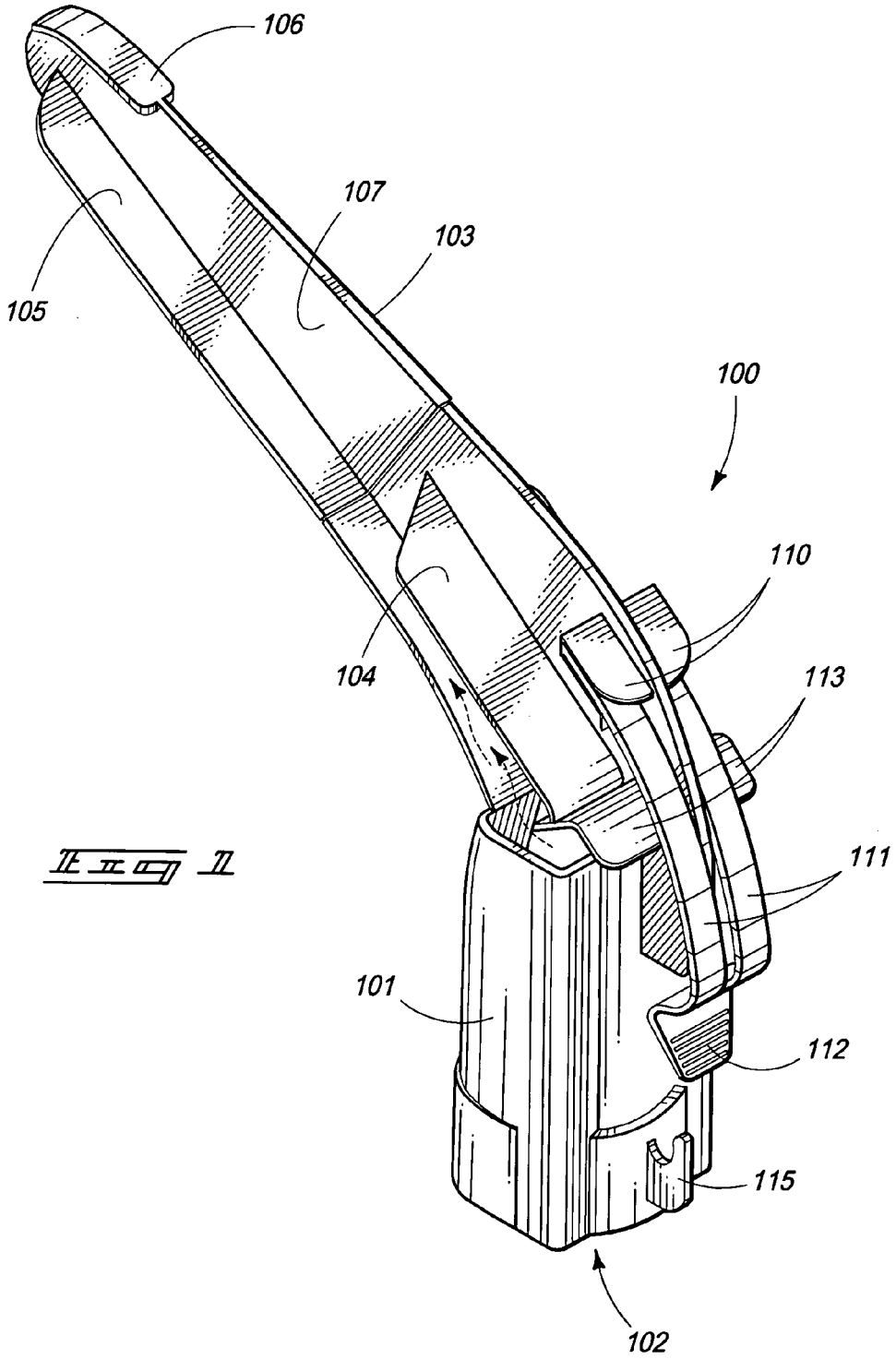
FIG. 1 is a rear-side isometric view of one embodiment of a reservoir bladder dryer system which may be used in practicing this invention.
Figure 2:
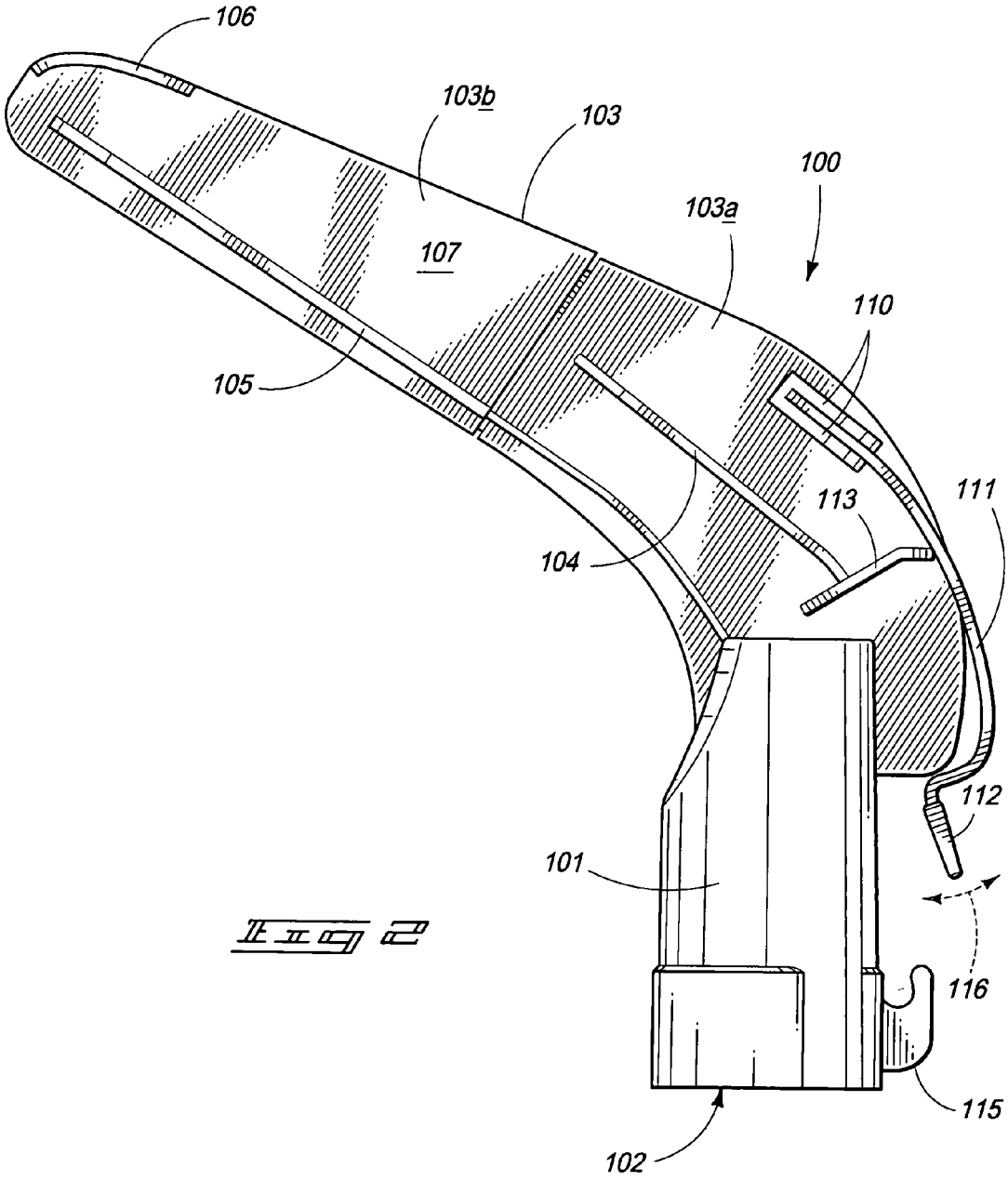
FIG. 2 is a first side view of the embodiment of the reservoir bladder dryer system illustrated in FIG. 1.

FIG. 1 is a rear-side isometric view of one embodiment of a reservoir bladder dryer system 100 which may be used in practicing this invention, illustrating center framework portion 107 (which may be one piece or dividable into a first section 103 and a second section 103*a* shown in FIG. 2), primary air guides 104, framework adapter 101, end air guide 106 with air inlet 102, return air guide 105, tab mounts 110, back pocket air guides 113, tab 111 with tab press portion 112, and water hose support 115.

A framework adapter 101 may be both an adapter to mount or position the system relative to a source of heat or may also provide part or all of an air inlet passageway. It will also be appreciated that the air inlet passageway may also provide a passageway for air to leave the internal cavity of the reservoir bladder. The end air guide 106 may also provide a broader area of support for the reservoir bladder mounted to the system. It will also be appreciated by those of ordinary skill in the art that while one or more configurations of air guides may be illustrated herein, there is no one number or configuration of air guides required to practice this invention.

In embodiments of this invention, the tab 111 may be substantially within the reservoir bladder when mounted, with only the tab press portion 112 on the exterior of the bladder. The tab 111 may be placed within the water or liquid inlet to the bladder and its outward spring bias then presses it against the interior surface of the water inlet to secure the reservoir bladder in position for drying (as shown for example in FIGS. 10 and 12). Press portion 112 may remain external to the reservoir bladder water inlet and be pressed inward against its spring bias to remove pressure and allow the reservoir bladder to be easily removed.

The framework may include differing portions of the system, including but not limited to, part or all of the air inlet passageway, a primary structural framework and air guides to direct the heated or supply air into the reservoir and in further embodiments, re-direct the air back out of the internal cavity of the reservoir.

It will be further appreciated by those familiar with the reservoir bladder industry that there are commonly sized apertures or water inlets with structures to allow the attachment and removal of caps to allow the input of water. This drying system is specially adapted for securing the reservoir bladders to the framework for drying through the water inlet not only in the primary internal cavity portion, but also in the back portion of the internal cavity. It is desired to eliminate the propensity for mold and other organics to form or accumulate in the entire bladder by using this drying system and not just in one portion or the other, such as in the primary internal cavity.

It will also be appreciated by those familiar with the reservoir bladder industry, including users of reservoir bladders, that the water conduit or hose through which a user draws or sucks water is preferably secured to avoid its further contamination on the ground or other surface. This invention provides a hose mount 115 sized to provide a holder to secure the hose to the framework during drying.

FIG. 2 is a first side view of the embodiment of the reservoir bladder dryer system illustrated in FIG. 1, and also illustrates center framework portion 107 (which may be one piece or dividable into a first section and a section 103 and a second section 103*a* shown in FIG. 2), primary air guides 104, framework adapter 101, end air guide 106 with air inlet 102, return air guide 105, tab mounts 110, back pocket air guides 113, tab 111 with tab press portion 112, and water hose support 115. Arrow 116 shows the movement of the biased tab 111. Like numbered and labeled components and items in this figure are also described elsewhere and will not therefore be discussed in detail here.

Figure 3:
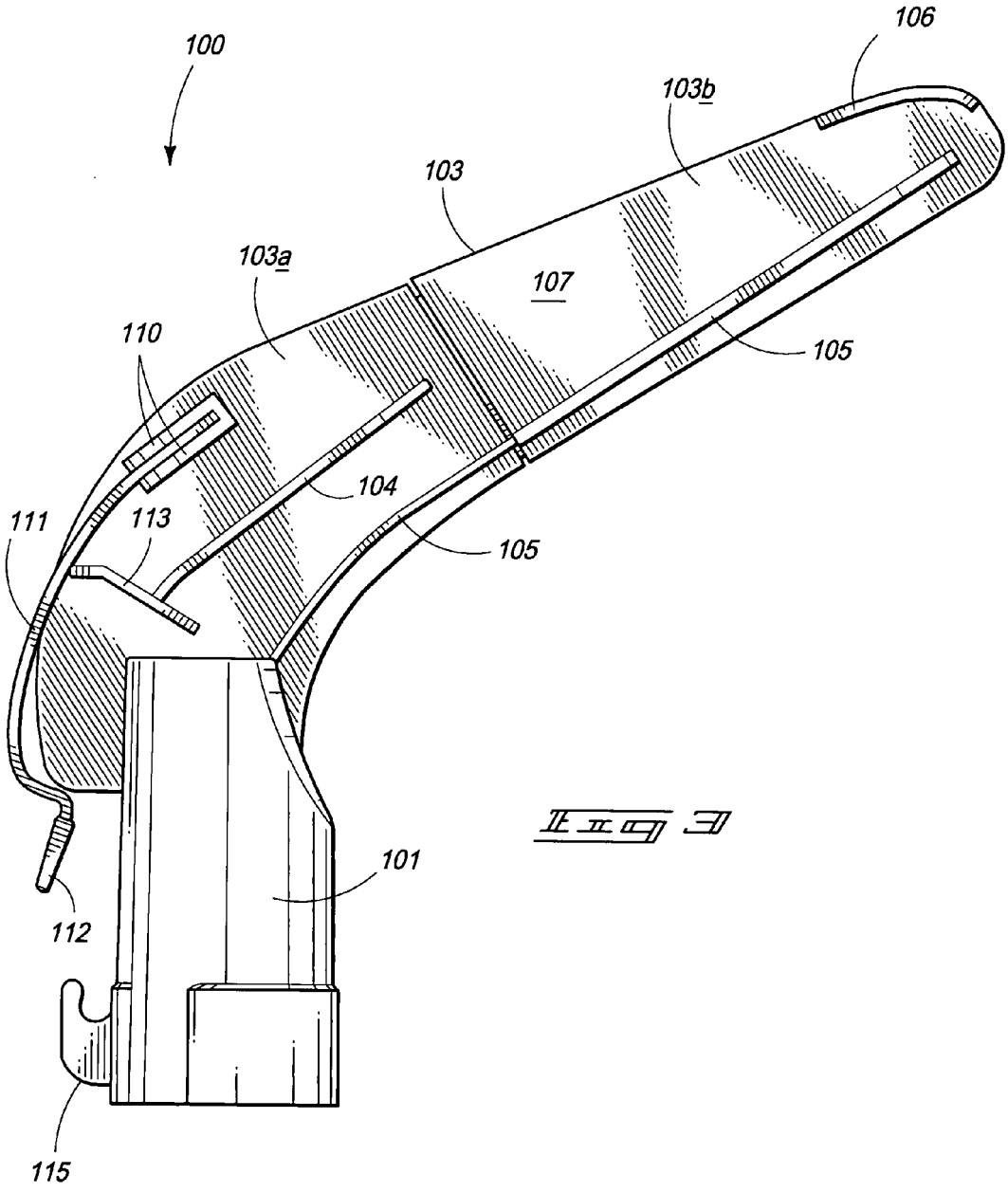
FIG. 3 is a second side view of the embodiment of the reservoir bladder dryer system illustrated in FIG. 1.

FIG. 3 is a second side view of the embodiment of the reservoir bladder dryer system illustrated in FIG. 1, and also illustrates center framework portion 107 (which may be one piece or dividable into a first section and a section 103 and a second section 103*a* shown in FIG. 2), primary air guides 104, framework adapter 101, end air guide 106 with air inlet 102, return air guide 105, tab mounts 110, back pocket air guides 113, tab 111 with tab press portion 112, and water hose support 115. Arrow 116 shows the movement of the biased tab 111. Like numbered and labeled components and items in this figure are also described elsewhere and will not therefore be discussed in detail here.

Figure 4:
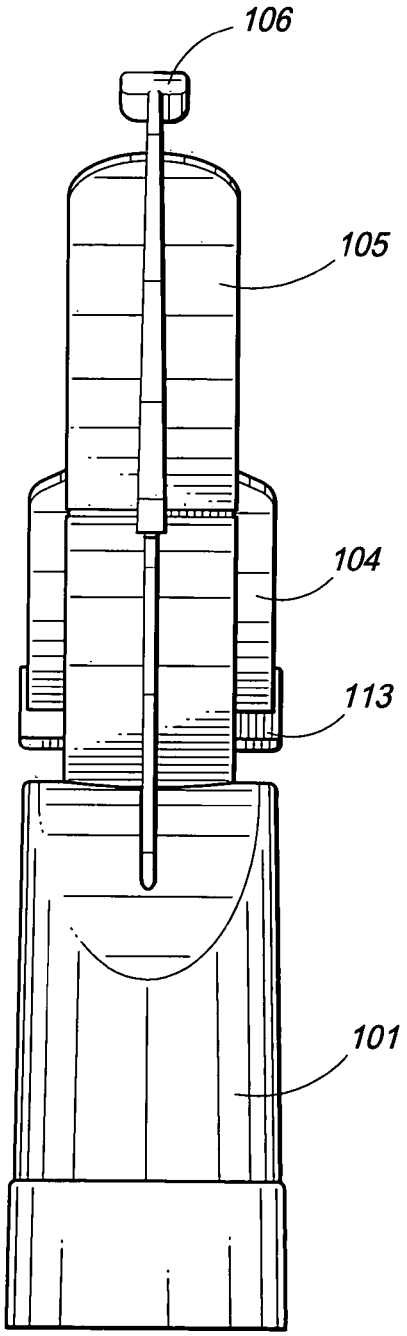
FIG. 4 is a first end view of the embodiment of the reservoir bladder dryer system illustrated in FIG. 1.

FIG. 4 is a first end view of the embodiment of the reservoir bladder dryer system illustrated in FIG. 1, and illustrates primary air guides 104, framework adapter 101, end air guide 106, return air guide 105, and back pocket air guides 113. Like numbered and labeled components and items in this figure are also described elsewhere and will not therefore be discussed in detail here.

Figure 5:
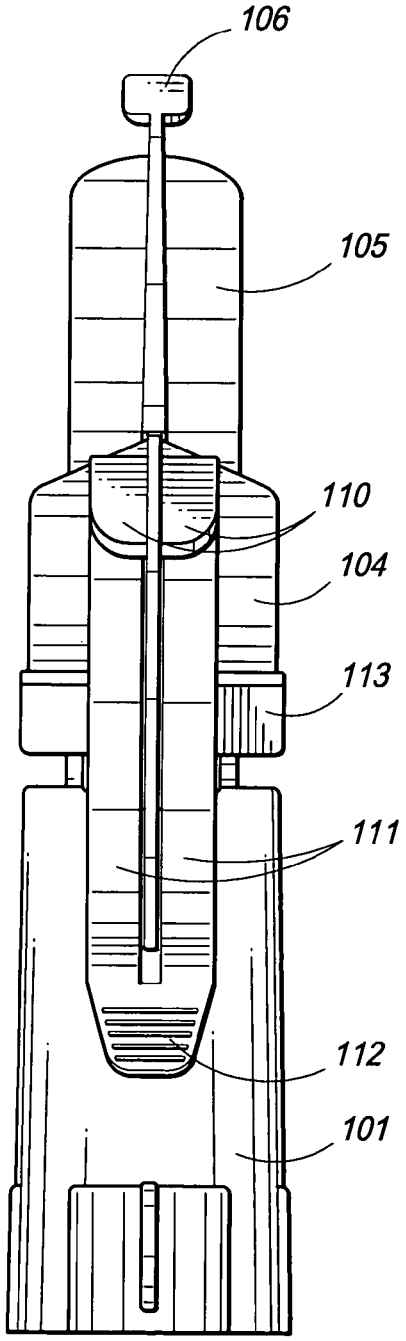
FIG. 5 is a second end view of the embodiment of the reservoir bladder dryer system illustrated in FIG. 1.

FIG. 5 is a second end view of the embodiment of the reservoir bladder dryer system illustrated in FIG. 1, illustrating primary air guides 104, framework adapter 101, end air guide 106, return air guide 105, tab mounts 110, tab press portion 112*a* and back pocket air guides 113. Like numbered and labeled components and items in this figure are also described elsewhere and will not therefore be discussed in detail here.

Figure 6:
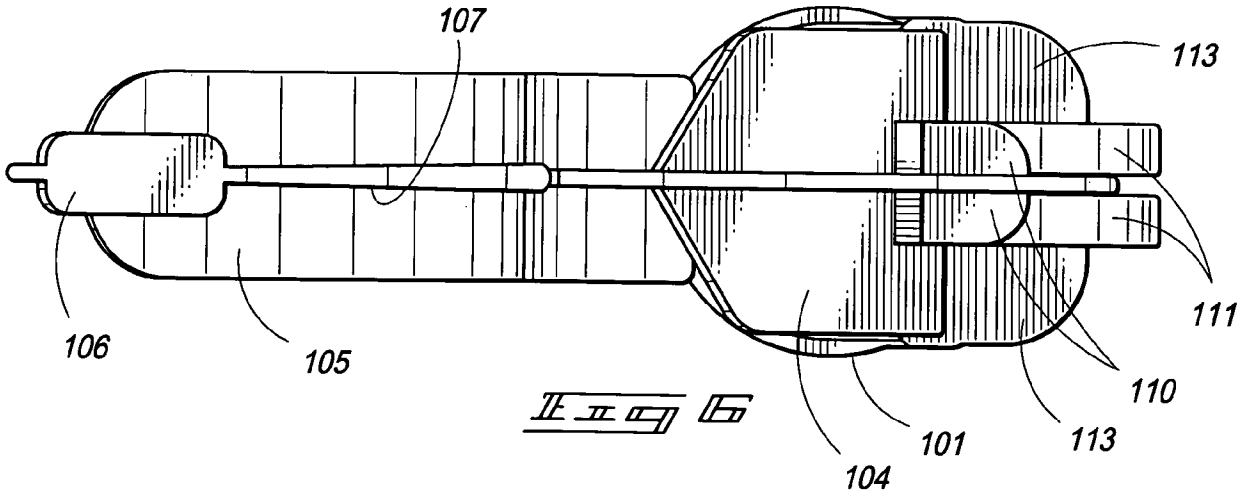
FIG. 6 is a top view of the embodiment of the reservoir bladder dryer system illustrated in FIG. 1.

FIG. 6 is a top view of the embodiment of the reservoir bladder dryer system illustrated in FIG. 1, illustrating center framework portion 107, primary air guides 104, framework adapter 101, end air guide 106, return air guide 105, tab mounts 110, tab 111, and back pocket air guides 113. Like numbered and labeled components and items in this figure are also described elsewhere and will not therefore be discussed in detail here.

Figure 7:
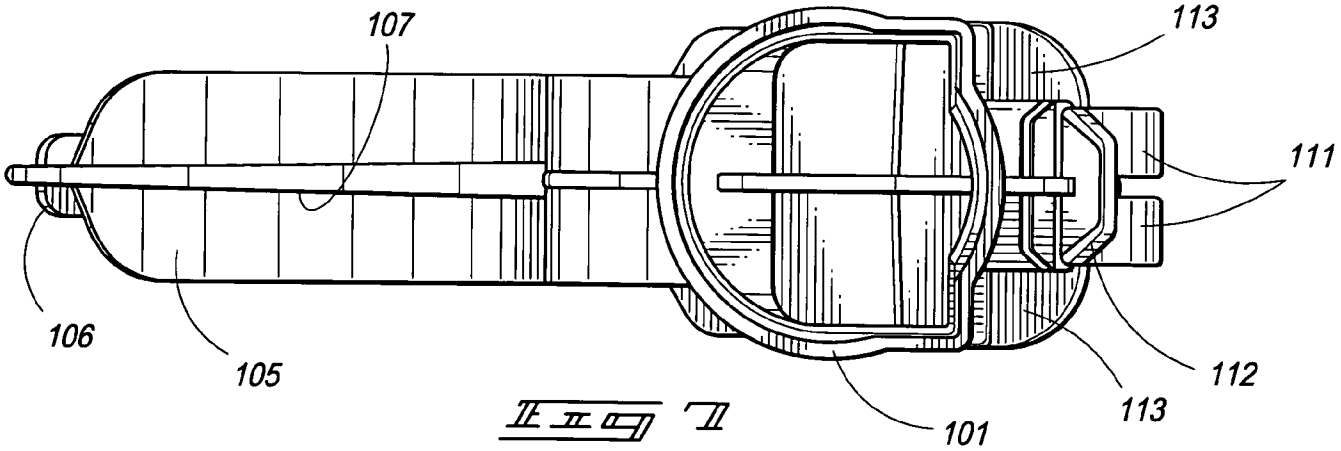
FIG. 7 is a bottom view of the embodiment of the reservoir bladder dryer system illustrated in FIG. 1.

FIG. 7 is a bottom view of the embodiment of the reservoir bladder dryer system illustrated in FIG. 1, illustrating center framework portion 107, framework adapter 101, end air guide 106, tab press portion 112, return air guide 105, tab 111, and back pocket air guides 113. Like numbered and labeled components and items in this figure are also described elsewhere and will not therefore be discussed in detail here.

Figures 8, 8A, 8B:
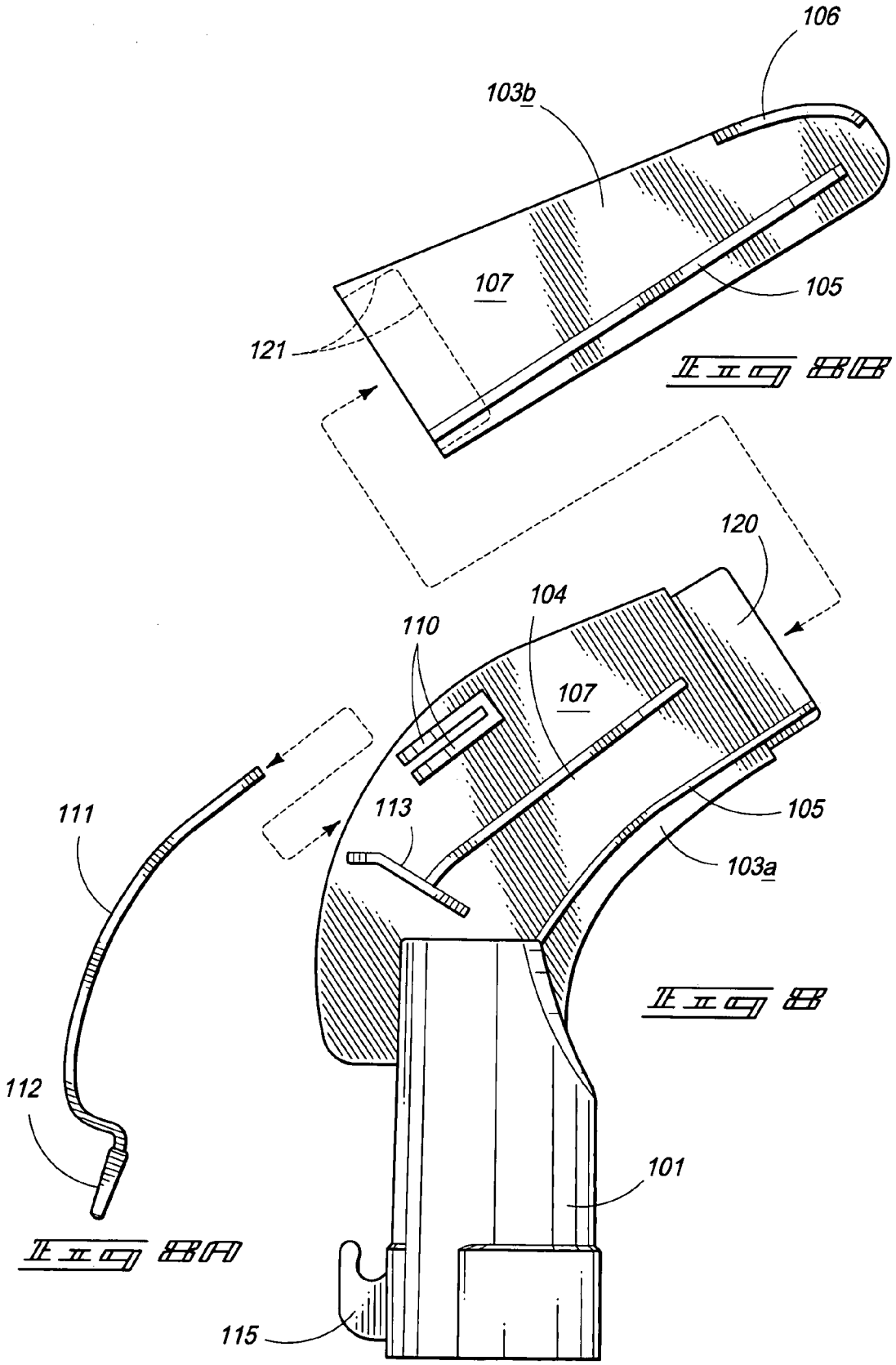
FIG. 8 is an exploded side view of the embodiment of the reservoir bladder dryer system illustrated in FIG. 1, illustrating how the different components may be configured for assembly.
FIG. 8A is part of the exploded side view of the embodiment of the reservoir bladder dryer system illustrated in FIG. 8, illustrating a deflectable tab which may be utilized to help secure the reservoir to the reservoir bladder dryer system during the drying process.
FIG. 8B is part of the exploded side view of the embodiment of the reservoir bladder dryer system illustrated in FIG. 8, illustrating the end body portion of the dryer system.

FIG. 8 is an exploded side view of the embodiment of the reservoir bladder dryer system illustrated in FIG. 1, illustrating how the different components may be configured for assembly, illustrating center framework portion 107 which is shown in FIG. 8 divided into a first section and a section 103 and a second section 103*a*, primary air guides 104, framework adapter 101, end air guide 106 with air inlet 102, return air guide 105, tab mounts 110, back pocket air guides 113, tab 111 with tab press portion 112, and water hose support 115. Arrow 116 shows the movement of the biased tab 111. Like numbered and labeled components and items in this figure are also described elsewhere and will not therefore be discussed in detail here.

FIG. 8A is part of the exploded side view of the embodiment of the reservoir bladder dryer system illustrated in FIG. 8, illustrating a deflectable tab 111 with tab press portion 112, which may be utilized to help secure the reservoir to the reservoir bladder dryer system during the drying process. FIG. 8B is part of the exploded side view of the embodiment of the reservoir bladder dryer system illustrated in FIG. 8, the end body portion 103*a* of the dryer system.

Figure 9:
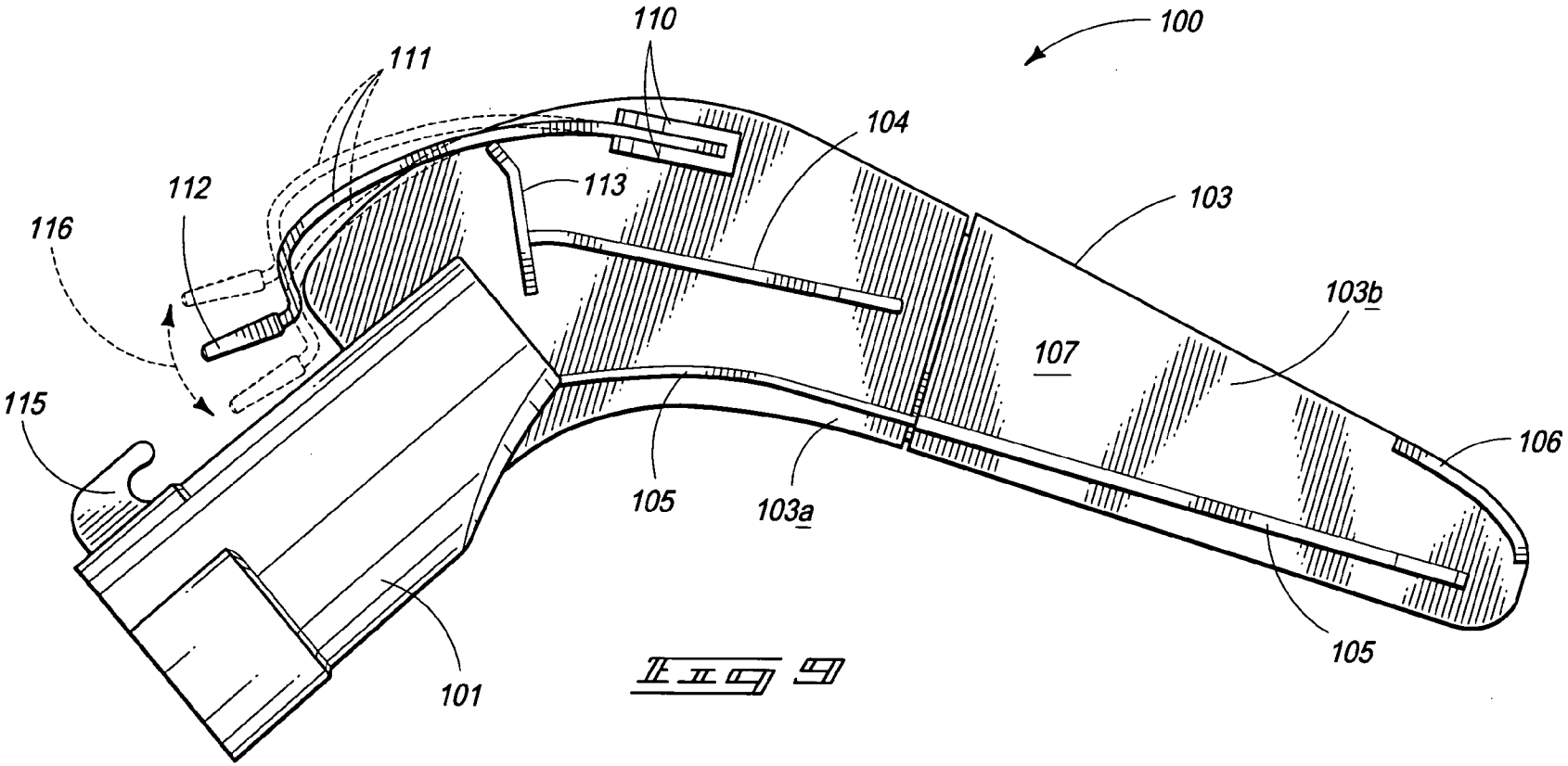
FIG. 9 is a second side view of the embodiment of the reservoir bladder dryer system illustrated in FIG. 3, but illustrating the movement of the deflectable tab which may be utilized to help secure the reservoir to the reservoir bladder dryer system during the drying process.

FIG. 9 is a second side view of the embodiment of the reservoir bladder dryer system illustrated in FIG. 3, but illustrating the movement of the deflectable tab which may be utilized to help secure the reservoir to the reservoir bladder dryer system during the drying process. FIG. 9 illustrates center framework portion 107, primary air guides 104, framework adapter 101, end air guide 106 with air inlet 102, return air guide 105, tab mounts 110, back pocket air guides 113, tab 111 with tab press portion 112, and water hose support 115. Arrow 116 shows the movement of the biased tab 111. Like numbered and labeled components and items in this figure are also described elsewhere and will not therefore be discussed in detail here.

Figure 10:
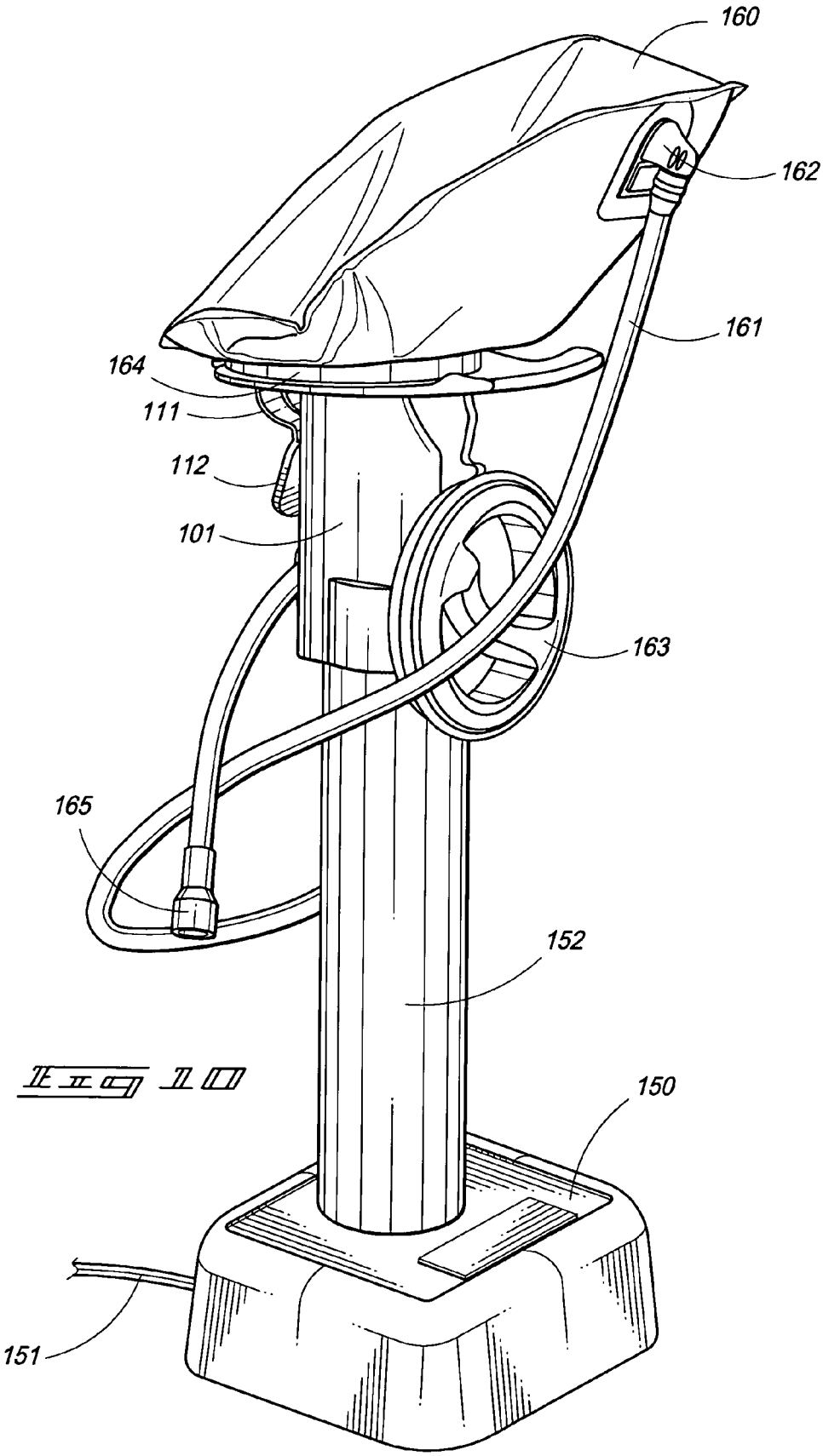
FIG. 10 is a rear-side isometric view of one embodiment of a reservoir bladder dryer system mounted on a dryer and dryer column, with a reservoir bladder mounted thereon, as it is mounted during drying.

FIG. 10 is a rear-side isometric view of one embodiment of a reservoir bladder dryer system mounted on a dryer and dryer column, with a reservoir bladder mounted thereon, as it is mounted during drying, illustrating heater base 150 (which houses the heater or source of heat), heater column 152 through which heated air is ducted or moved to the system framework, and electrical cord 151 for the electrical heater embodiments. FIG. 10 serves to also illustrate the basic components of a typical reservoir bladder, such as bladder 160, water hose 161 or conduit, mouthpiece 165 and water inlet structure 164. The water hose 161 is mounted to reservoir bladder 160 by adapter 162 and through which water may be sucked by the user into the water hose. Water inlet cap 163 is inserted into the water inlet structure 164 (typically by screwing it in via mating threads on the water inlet cap 163 and the interior diameter of the water inlet structure 164. The upper portion to the right on the figure is the main or primary portion of the reservoir body and the primary portion of the internal cavity, whereas the opposite side to the left of the water inlet structure 164 is the back portion of the bladder and the back portion of the internal cavity for purposes of drying the internal cavity of the reservoir bladder 160.

Figure 11:
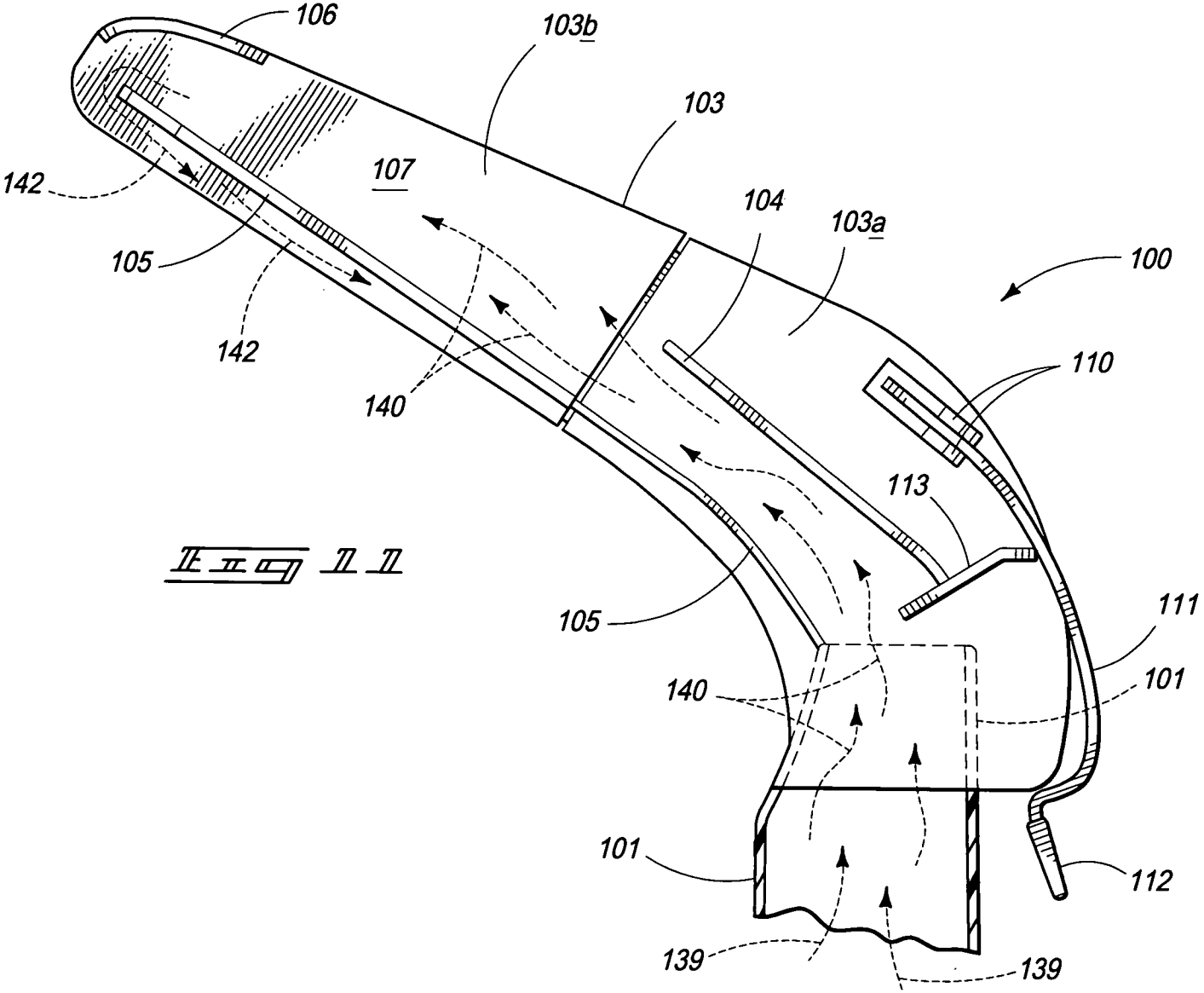
FIG. 11 is a second side view of the embodiment of the reservoir bladder dryer system illustrated in FIG. 2, but illustrating the movement of heated air promoted by the dryer body.
Figure 11:
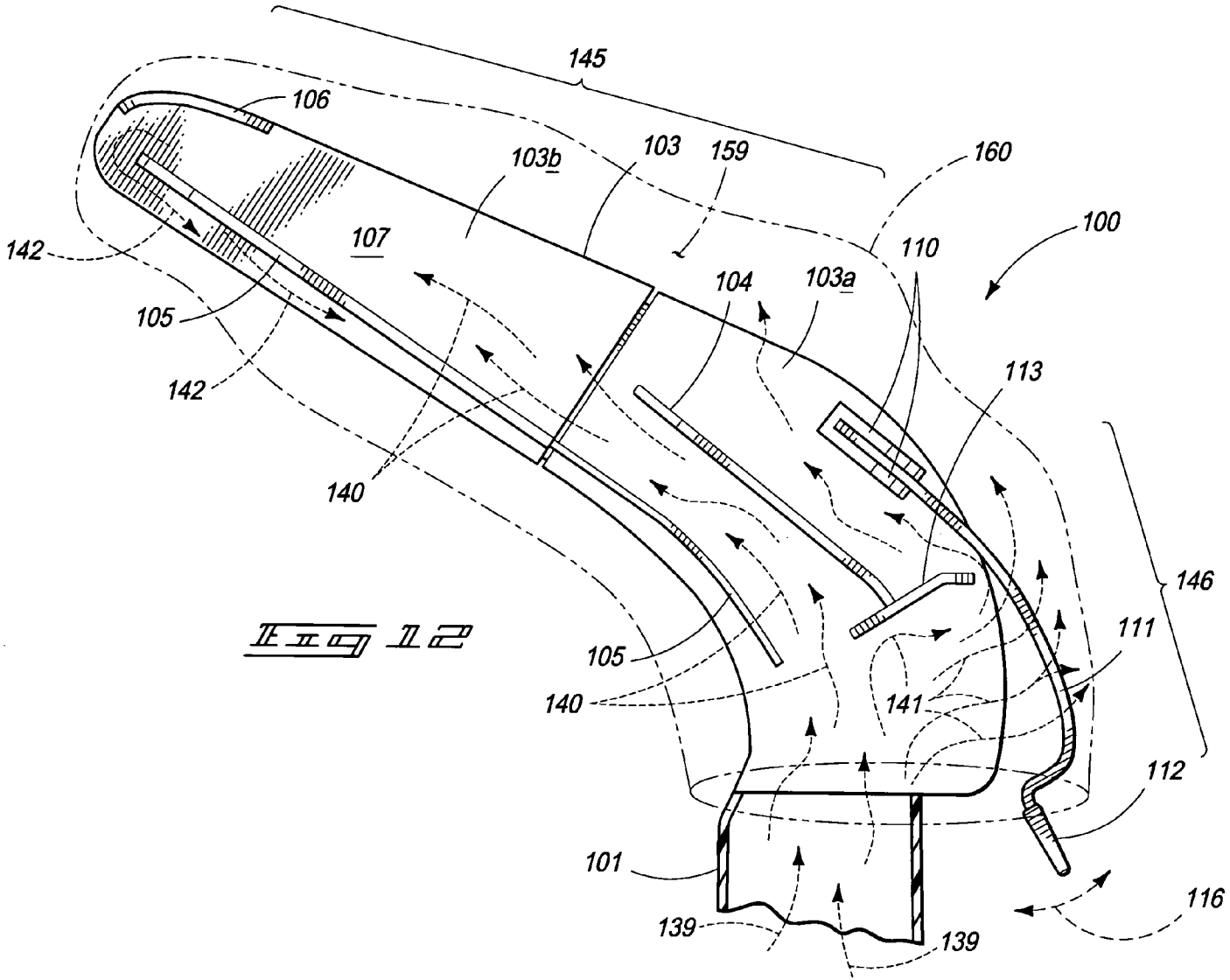

FIG. 11 is a second side view of the embodiment of the reservoir bladder dryer system illustrated in FIG. 2, but illustrating the movement of heated air promoted by the dryer body, illustrating center framework portion 107 with a first section 103 and a second section 103*a*, primary air guides 104, framework adapter 101, end air guide 106 with air inlet 102, return air guide 105, tab mounts 110, back pocket air guides 113, tab 111 with tab press portion 112, and water hose support 115. Like numbered and labeled components and items in this figure are also described elsewhere and will not therefore be discussed in detail here.

FIG. 11 illustrates some of the air flow provided by this drying system, including a source of air 139 received by the framework. Arrows 140 illustrate the primary flow of air to the main portion of the internal cavity (shown in FIG. 12) of the reservoir bladder, with arrows 142 illustrating air returning or pushed out by new air.

FIG. 12 is a second side view of the embodiment of the reservoir bladder dryer system illustrated in FIG. 2 with a bladder mounted thereon, and illustrating the movement of heated air both toward the main portion of the internal cavity of the bladder and toward the back pocket of the internal cavity of the bladder, illustrating center framework portion 107 with a first section 103 and a second section 103*a*, primary air guides 104, framework adapter 101, end air guide 106 with air inlet 102, return air guide 105, tab mounts 110, back pocket air guides 113, tab 111 with tab press portion 112, and water hose support 115. Like numbered and labeled components and items in this figure are also described elsewhere and will not therefore be discussed in detail here.

FIG. 12 also illustrates some of the air flow provided by this drying system, including a source of air 139 received by the framework. Arrows 140 illustrate the primary flow of air to the main or primary portion 145 of the internal cavity 159 of the reservoir bladder 160, with arrows 142 illustrating air returning or pushed out by new air. FIG. 12 also illustrates air flow to the back pocket portion 146 of the internal cavity of the reservoir bladder, with air flow represented by arrows 141, as directed or guided by back pocket air guides 113.

As will be appreciated by those of reasonable skill in the art, there are numerous embodiments to this invention, and variations of elements and components which may be used, all within the scope of this invention. In one embodiment for example, a dryer for insertion into a cavity of a reservoir bladder with a fill inlet, a primary internal cavity and a back pocket cavity portion, providing a dryer which includes a framework configured for insertion into a water inlet of an internal cavity of reservoir bladder which includes a primary internal cavity and a back pocket cavity portion; and a first air passageway formed by the framework and configured to receive heated air and to direct the heated air to the primary internal cavity. In additional or further embodiments to the forgoing, such a dryer may be provided: which further comprises a second air passageway formed by the framework and configured to direct heated air to the back pocket cavity portion; a biased tab mounted to the framework configured to provide, a biased securing tab for applying outward pressure to the water inlet of the reservoir bladder, for securing the reservoir bladder to the framework; and/or further wherein the framework is configured to mount to an air supply passageway to receive heated air therefrom. In yet another embodiment, the dryer may be provided wherein the framework is configured to mount to an air supply passageway and further wherein the air supply passageway is configured to receive heated air from a heater.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A dryer for insertion into a cavity of a reservoir bladder with a water fill inlet, a primary internal cavity and a back pocket cavity portion, the dryer comprising:

a framework configured for insertion into a water fill inlet of an internal cavity of reservoir bladder which includes a primary internal cavity and a back pocket cavity portion, the framework including primary air guides which are defined by external surfaces of the framework, and wherein the framework is further configured to generally support the reservoir bladder in an expanded position from within the primary internal cavity and provide an air path into the primary internal cavity, and back pocket air guides which are defined by external surfaces of the framework on an opposing side of the framework which are configured to provide support for the back pocket cavity portion; and a first air passageway formed by the framework and configured to receive heated air and to direct the heated air to the primary internal cavity.

2. A dryer for insertion into a cavity of a reservoir bladder as recited in claim 1, and further wherein the framework is further configured to generally support the back pocket cavity portion in an expanded position from within the primary internal cavity and further still further comprising a second air passageway formed by the back pocket air guides and configured to direct heated air to the back pocket cavity portion.

3. A dryer for insertion into a cavity of a reservoir bladder as recited in claim 1, and further comprising a biased tab mounted to the framework configured to provide a biased securing tab for applying outward pressure to the water inlet of the reservoir bladder, for securing the reservoir bladder to the framework.

4. A dryer for insertion into a cavity of a reservoir bladder as recited in claim 1, and further wherein the framework is configured to mount to an air supply passageway to receive heated air therefrom.

5. A dryer for insertion into a cavity of a reservoir bladder as recited in claim 4, wherein the framework is configured to mount to an air supply passageway and further wherein the air supply passageway is configured to receive heated air from a heater.

* * * * *